United States Patent [19]

Heckenhauer

[11] 4,193,638

[45] Mar. 18, 1980

[54] MULTIPLE TIP CUTTING BIT FOR ROTARY DRUM-TYPE CUTTER

[75] Inventor: William G. Heckenhauer, Bucyrus, Ohio

[73] Assignee: Dresser Industries, Inc., Dallas, Tex.

[21] Appl. No.: 905,616

[22] Filed: May 12, 1978

[51] Int. Cl.[2] ..... E21C 35/18

[52] U.S. Cl. ..... 299/89; 299/91; 175/383; 407/99; 407/113

[58] Field of Search ..... 299/39, 86, 89, 91, 299/92; 175/227, 383, 407; 37/141, 142; 407/46, 91, 99, 109, 110, 113, 114; 74/813 L, 826

[56] References Cited

U.S. PATENT DOCUMENTS

| | | | |
|---|---|---|---|
| 2,150,189 | 3/1939 | Ronneberg | 175/383 |
| 3,117,386 | 1/1964 | Ferwerda | 172/735 X |
| 3,277,973 | 10/1966 | Eberman | 175/407 |
| 3,485,533 | 12/1969 | Proctor | 299/92 |
| 3,544,166 | 12/1970 | Proctor | 37/142 R X |
| 4,006,936 | 2/1977 | Crabiel | 299/92 X |

*Primary Examiner*—Ernest R. Purser
*Assistant Examiner*—Nick A. Nichols, Jr.
*Attorney, Agent, or Firm*—John M. Lorenzen

[57] ABSTRACT

A particularly better rotary cutter for a road planing machine and the like has special holders provided with multi-sided tapered sockets extending generally tangential to the drum surface. A multiple tip cutting bit suitable for use with the aforementioned cutter has two or more tips symmetrically and equidistantly spaced about the projected centerline of an integral tapered shank. The shank has a multi-sided cross-sectional shape corresponding in arrangement to the pattern of the cutting tips, such that the bit can be indexed in its holder to place any selected one of the cutting tips in the operative position.

7 Claims, 15 Drawing Figures

MULTIPLE TIP CUTTING BIT FOR ROTARY DRUM-TYPE CUTTER

The present invention relates to an improved bit for a rotary cutter, such as the cutters used on road planning or mining machines. More particularly, the invention concerns a bit having more than one cutting tip and which can be indexed in its holder to position a new tip in cutting position when a previous one wears out or breaks.

U.S. Pat. No. 4,006,936 illustrates and describes an improved rotary cutter for a road planing machine. The cutter consists of a rotatable drum around which specially designed bit holders are disposed in a pre-selected pattern. Each holder has a multi-sided tapered socket having a centerline extending generally tangential to, but spaced from, the surface of the drum. The bits disclosed in this patent each have a correspondingly tapered shank and a single cutting tip disposed such that, as it cuts material, the reactive forces act along the centerline of the bit's shank to further snug the bit in the socket of its holder.

The rotary cutter of U.S. Pat. No. 4,006,936 goes a long way to reduce operating costs for a road planer. In prior cutters the bits were fashioned to fit loosely in their holders, usually being held by some separate locking means, and would work against their holders during the cyclical cutting operation. As a result the holders became worn; making it necessary to replace or recondition the entire cutter. But, in the improved cutter, since the bits are always held snugly in their sockets, wear of the bit holders has been either eliminated or at least minimized. However, it is still necessary to replace the bits as their cutting tips wear out, and this may represent a substantial operating cost for the owner of such machines.

Therefore, it is the object of the present invention to provide a bit for a rotary cutter, such as that described in U.S. Pat. No. 4,006,936, which has longer life owing to the fact it has more than one cutting tip.

This is achieved by a bit having two or more cutting tips symmetrically arranged and equally spaced about the projected centerline of the bit's shank, and having a multi-sided symmetrical tapered shank generally corresponding in cross-section to the pattern of the bits. The bit shank is sized and shaped to fit in a similarly shaped and tapered socket on the rotary cutter, and the cutting tips are each disposed such that, when cutting, the reactive forces act along the centerline of the shank.

The improved bits are easily and quickly insertable or removable from their sockets in accordance with the teaching of the aforementioned patent. However, as a further improvement the present bits are provided with axially aligned protrusions at both the face and shank ends. When the bit is inserted in its holder, a firm hammer tap on the face protrusion will properly and snugly seat the bit. Conversely, a hammer blow to the protrusion at the shank end will free the bit from its holder when replacement or indexing is required.

Further and more detailed description of the invention follows with reference to the accompanying drawings, which form part of this specification, and of which:

Figure 1:
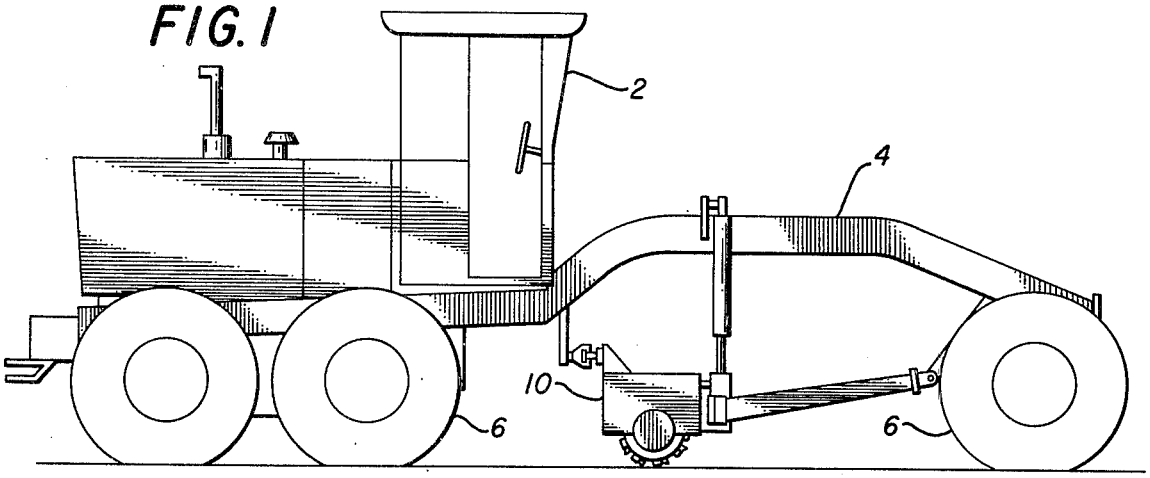
FIG. 1 is a side view of a typical road planing machine.
Figure 2:
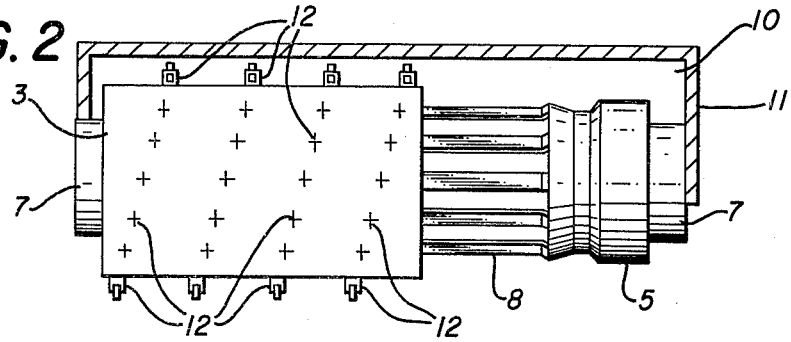
FIG. 2 is an enlarged view of the rotary cutter from the machine of FIG. 1.
Figure 3:
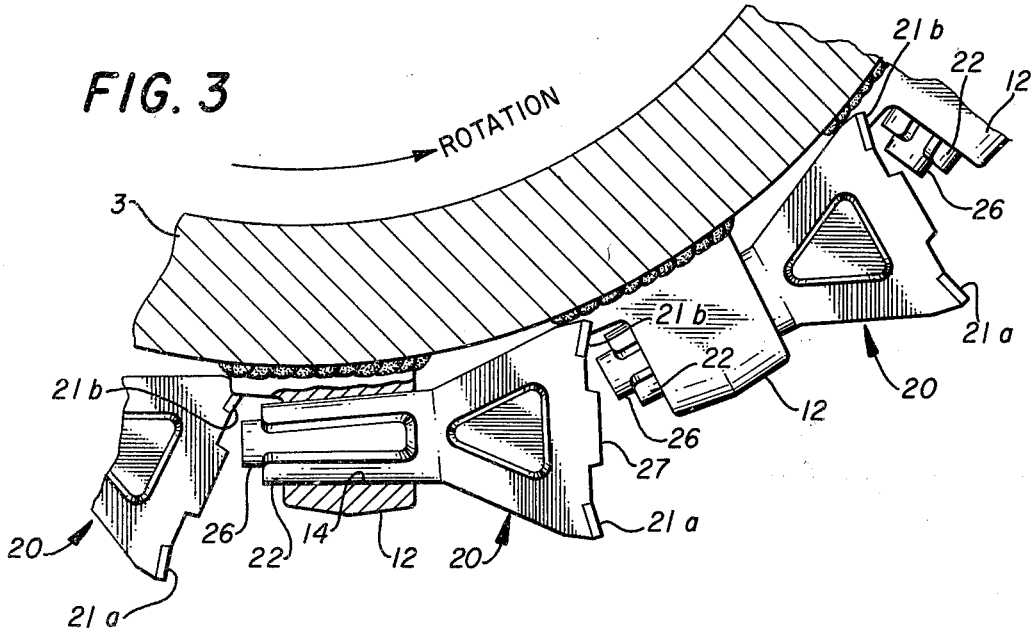
FIG. 3 is a further enlarged view, partly in cross-section, of a portion of the cutter from FIG. 2 and showing cutting bits embodying the invention in the installed condition.
Figure 4:
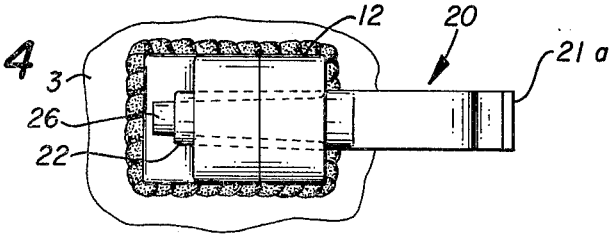
FIG. 4 is another view of the installed bit of FIG. 3 as taken looking radially inward toward the rotary cutter.

A typical road planar consists of a vehicle 2 having a planing, milling or cutting head 10 suspended under its chassis 4 and usually within the boundaries of its wheels 6. Referring to FIGS. 2, 3, and 4, the cutting head 10 consists of a rotary cutter 3 and its drive 5 mounted on bearings 7 within a housing 11. A spacer 8 allows the use of different width cutters in the same housing. The rotary cutter 3 is laced according to a pre-selected pattern with bit holders as indicated by the numerals 12.

A more detailed description of the rotary cutter 3 can be found in U.S. Pat. No. 4,006,936, but the following general features are necessary to an understanding of the improved cutting bits discussed hereinafter. The bit holders 12 are usually welded to the drum 3. Each holder has a tapered socket 14 which is aligned generally tangential to the drum surface, although spaced somewhat outward of a true tangent, and which extends all the way through the holder. Bits suitable for use with these holders each have a shank which is correspondingly tapered to mate in the tapered socket of its holder 12. The shank is preferably longer than the socket so it extends through and beyond the socket when installed.

When the cutter 3 is in operation, for instance milling asphalt or concrete from a roadway, the reactive forces on the bits act parallel to the centerline of their shanks and thus aid in keeping the bits firmly seated in their holders. This eliminates wear on the sockets of the holders and reduces the need to replace or recondition the cutter drum 3. At the same time, the bits can be replaced quickly and easily at the work site.

However, to provide longer bit life, the improved bits shown in FIGS. 5–10 and 13–15, include the foregoing mentioned features, but are also provided with more than one cutting tip. The cutting tips are usually inserts of a hardened material, such as tungsten carbide, and are shaped and aligned in accordance with the characteristics of the material to be cut. For convenience, the cutting tips will be considered identical in the discussion of the various embodiments which follows.

Figure 5:
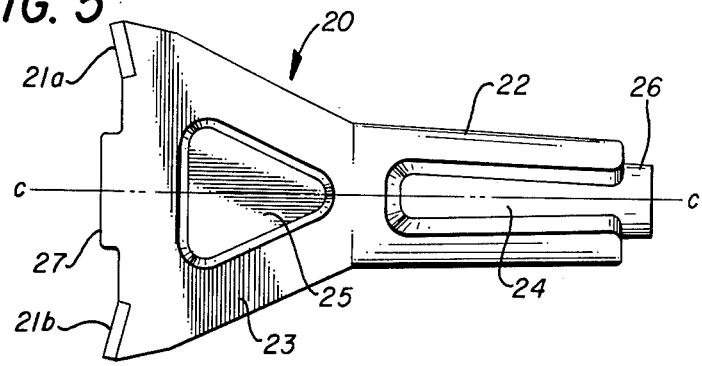
FIG. 5 is a side view of one embodiment of the invention in the form of a cutting bit having two cutting tips.
Figure 7:
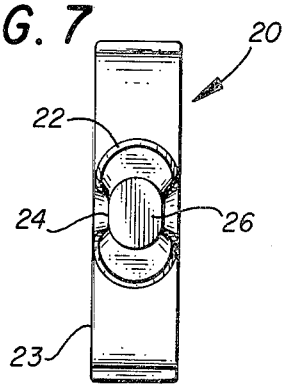
FIG. 7 is a shank end view of the bit of FIG. 5.
Figure 6:
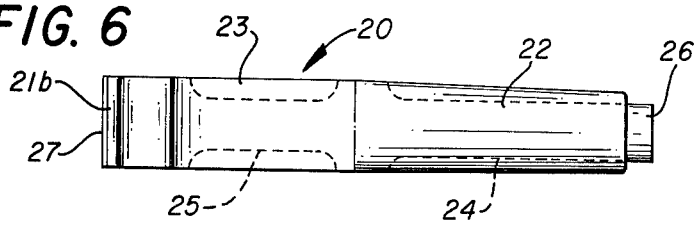
FIG. 6 is a top view of the bit of FIG. 5.

The bit 20 of FIGS. 5–7 has two cutting tips, indicated as 21*a* and 21*b*, and is also the bit which is shown in FIGS. 3 and 4. The bit also includes a shank 22 integrally connected to a trapezoidal shaped head or body 23. The shank tapers away from the head and symmetrically about its centerline c—c. The head also diverges symmetrically and the cutting tips 21*a* and 21*b* are equally spaced from the centerline c—c. Referring to FIG. 6, the bit 20 is relatively narrow, yet a slight taper to the sidewalls of the shank 22 is desirable. As indicated at 24 and 25, the sides of the bits are relieved to save material, reduce the weight, and along with the tapered sidewalls make insertion in the holders easier.

FIG. 3 shows a bit 20 installed with cutting tip 21*a* in cutting position and tip 21*b* in a stored position. When tip 21*a* is worn, the bit is removed and indexed 180° to put tip 21*b* in the operative position. Since both tips are the same distance from the centerline of the symmetrical taper 22, the cutting force reactions operate the same regardless of which tip is in service.

A protrusion 26, which is smaller in peripheral dimension, extends from the back end of the shank 22. This protrusion provides a striking surface for a hammer blow when knocking a bit loose from its holder. Striking the protrusion 26 rather than the end of the shank eliminates the risk of mushrooming the latter, which in turn could hinder or prohibit removal of the bit. Similarly a protrusion 27 is provided on the face of the bit as a striking surface for a hammer blow to initially seat the bit in its holder. The protrusion 27 reduces the risk of a misplaced blow leading to damage of a cutting tip.

Figure 8:
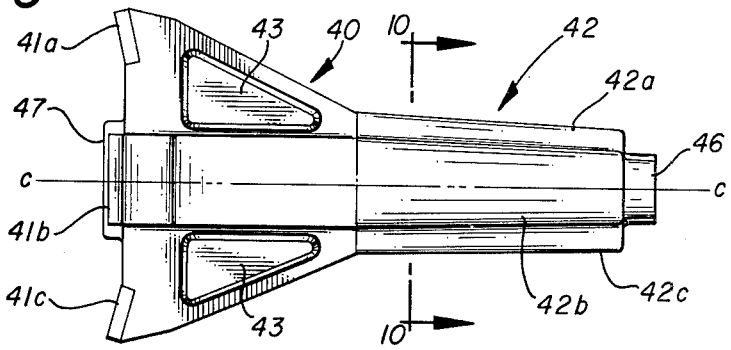
FIG. 8 is a side view of another embodiment of the invention in the form of a cutting bit having four cutting tips.
Figure 9:
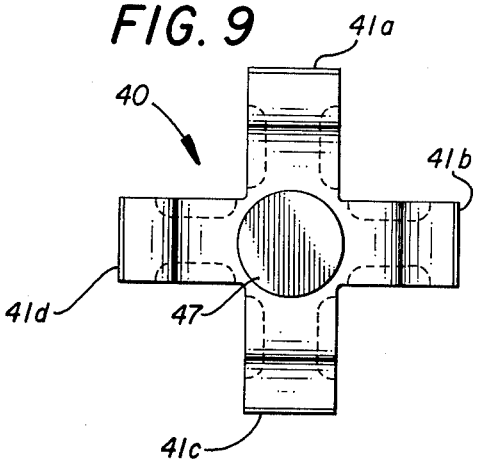
FIG. 9 is a face end view of the bit of FIG. 8.
Figure 10:
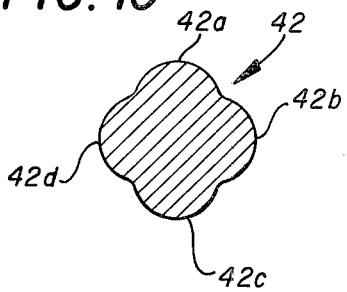
FIG. 10 is a cross-sectional view through the shank of the bit of FIG. 8 as taken along the line 10—10 in FIG. 8.

The bit 40 of FIGS. 8–10 has four cutting tips 41*a*, 41*b*, 41*c*, and 41*d*, arranged at the extremeties of a symmetrical cross. The head 43 of this bit consists of two perpendicularly intersecting trapezoids the larger ends of which form the cross-shaped face. The shank 42 of this bit is again symmetrically tapered about the centerline c—c and has four lobes 42*a*, 42*b*, 42*c*, and 42*d* arranged respectively to the pattern of the cutting tips 41*a*, 41*b*, 41*c*, and 41*d*.

The bit 40 is also provided with striking protrusions 46 and 47 on its shank and face ends respectively, in the same manner and for the same purpose as discussed in regard to bit 20.

Figure 11:
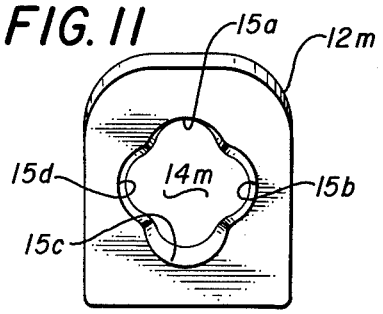
FIG. 11 is an end view of a bit holder for the bit of FIG. 8.
Figure 12:
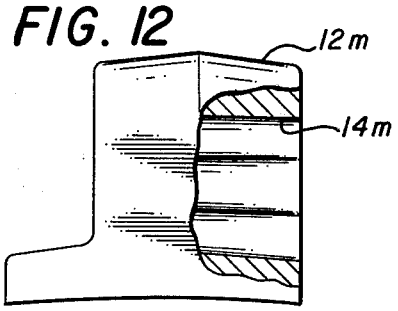
FIG. 12 is a side view of the bit holder of FIG. 11.

Unlike bit 20, which can be used in the previously standard bit holder 12, bit 40 would require modification to the socket of the holder. Accordingly FIGS. 11 and 12 show an example of a bit holder 12*m* with a modified socket 14*m* having a cross-sectional shape corresponding to that of the shank 42. It should be noted, however, that the socket 14*m* need not be identical to the cross-section of shank 42 as long as it is relieved to receive the side lobes 42*b* and *d*. The recesses 15*a* and *c* will be adequate to align and hold the bit 40 if they are matched to the tapered lobes of shank 42.

Figure 13:
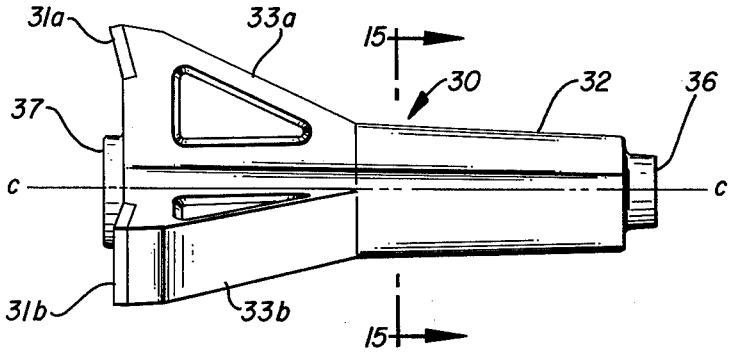
FIG. 13 is a side view of still another embodiment of the invention in the form of a bit having three cutting tips.
Figure 14:
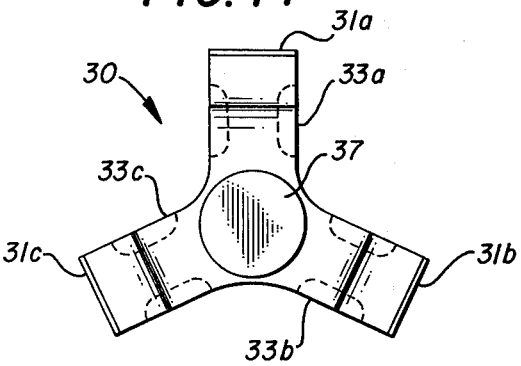
FIG. 14 is a face end view of the bit of FIG. 13.
Figure 15:
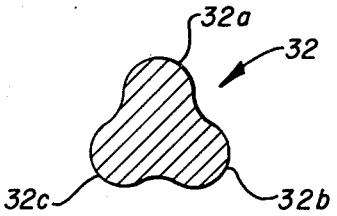
FIG. 15 is a cross-sectional view through the shank of the bit of FIG. 13 as taken along the lines 15—15 in FIG. 13.

A similar modification to a bit holder would be required to accommodate the bit 30 of FIGS. 13–15 which has three cutting tips 31*a*, 31*b*, and 31*c*, arranged at the vertices of an imaginary equilateral triangle. Again, the bit includes a head 33 having three diverging walls 33*a*, 33*b*, and 33*c* leading to the Y-shaped face, and a tapered shank 32 having lobes 32*a*, 32*b*, and 32*c*, arranged symmetrically about its centerline c—c corresponding to the pattern of the cutting tips 31*a*, 31*b*, and 31*c*. And for the reasons discussed earlier, the bit 30 is also provided with protrusion 36 on its shank end and protrusion 37 centrally located on its face.

It should be apparent that a number of other multi-tip patterns are conceivable; hexagonal or octagonal among the most obvious, although the number of tips and the shape will be limited by practical factors including manufacturability and desired cutting depth. However, it is in keeping with the invention that the tips be equally spaced about and equi-distant from the forwardly projected centerline of the tapered bit shank and that the shank have a cross-sectioned configuration bearing some corresponding similarity and relationship to the pattern of the cutting tips.

While the improved bits embodying the invention have been discussed in terms of application to a rotary cutter for road planing machines, it is fully appreciated that such bits could be used on rotary cutters in other applications such as on mining machines.

The embodiments of the invention in which an exclusive property or privilege is claimed are defined as follows:

1. A multiple tip cutting bit, for a rotary drum-type cutter laced with bit holders each of which has a tapered socket extending generally tangential to the drum surface, comprising:

a tapered shank adapted to seat snugly in the matching socket of one of the bit holders; and a head integrally joined to the shank and having at least two diverging walls extending away from the shank, the divergent ends of said walls forming a face lying in a plane perpendicular to the centerline of the shank and having a cutting tip at the outer edge of each divergent wall, wherein said cutting tips are symmetrically and equidistantly spaced about the projected centerline of the shank, and wherein the shank has a cross-sectional shape corresponding to the pattern formed by said cutting tips such that the bit can be indexed in its holder to place any selected one of said cutting tips in the operative position where it alone will come in contact with the workpiece as the cutter rotates.

2. A cutting bit as recited in claim 1 wherein the head is trapezoidal shaped and is integrally joined to the shank along its narrowest base, the wide base of the trapezoid forming the face of the bit with a cutting tip located at each of the two outer edges of the face.

3. A cutting bit as recited in claim 1, wherein the face of the bit is cross-shaped and has four cutting tips arranged one at each end of the cross.

4. A cutting bit as recited in claim 1, wherein the face of the bit is Y-shaped and has three cutting tips arranged one at each end of the Y.

5. A cutting bit as recited in claim 1, wherein the tapered shank is longer than its intended mating socket and has a protrusion extending from its distal end, said protrusion being smaller in peripheral dimensions than the shank end and forming a striking surface for a hammer blow used to loosen the bit from its socket.

6. A cutting bit as recited in claim 1, further including a protrusion extending from the face of the bit and centrally located between the cutting tips and forming a striking surface for a hammer blow to seat the bit in its socket.

7. In a cutting bit for a rotary cutter, for a road planer or the like, which has a head and an integral shank which is tapered to fit snugly in a matching tapered socket on the rotary cutter such that the centerline of the shank is spaced outward from but extends generally tangential to the surface of the rotary cutter, the improvement wherein the head diverges away from its connection to the shank to form a face lying in a plane perpendicular to the centerline of the shank and incorporating at least two cutting edges spaced symmetrically about and equidistantly from a forward projection of the shank centerline, and wherein the shank has a symmetrically shaped cross-section corresponding to the pattern formed by said cutting edges such that the bit can be indexed in its holder to place any selected one of the cutting edges alone in the operative position radially outermost from the cutter's axis.

* * * * *